343-909 SR
3/14/78 XR 4,079,382

United States Patent [19]

Henry

[11] 4,079,382

[45] Mar. 14, 1978

[54] FREQUENCY MULTIPLEXER EMPLOYING A BLAZED DIFFRACTION GRATING

[75] Inventor: Paul Shala Henry, Holmdel, N.J.

[73] Assignee: Bell Telephone Laboratories, Incorporated, Murray Hill, N.J.

[21] Appl. No.: 743,074

[22] Filed: Nov. 18, 1976

[51] Int. Cl.[2] ..... H01Q 15/02

[52] U.S. Cl. ..... 343/753; 343/840; 343/909; 350/162 R

[58] Field of Search ..... 343/754, 755, 840, 909, 343/753; 350/162 R

[56] References Cited

U.S. PATENT DOCUMENTS

| | | | |
|---|---|---|---|
| 2,530,580 | 11/1950 | Lindenblad | 343/755 |
| 2,665,383 | 1/1954 | Marie | 343/909 |
| 3,144,606 | 8/1964 | Adams et al. | 343/909 |

*Primary Examiner*—Eli Lieberman
*Attorney, Agent, or Firm*—Erwin W. Pfeifle

[57] ABSTRACT

The present invention relates to a quasi-optical frequency multiplexer which permits the bidirectional conversion of at least two intermediate angularly-distinct planar wavefronts, where each distinct planar wavefront corresponds to the wavelength of a separate radio channel, into a single directional wavefront by the use of a blazed diffraction grating mounted at the aperture of an antenna. More particularly, a single directional planar wavefront, comprising the wavelengths of at least two radio channels, is diffracted out of the blazed diffraction grating into at least two angularly-distinct intermediate planar wavefronts corresponding to the at least two radio channels. By properly placing separate feedhorns at the precise location on the focal plane of the antenna where each angularly-distinct intermediate planar wavefront is focused, the radio channels can be separated, or alternately combined in the reverse manner.

4 Claims, 5 Drawing Figures

FREQUENCY MULTIPLEXER EMPLOYING A BLAZED DIFFRACTION GRATING

BACKGROUND OF THE INVENTION

1. Field of the Invention

The present invention relates to a frequency multiplexer employing a blazed diffraction grating and, more particularly, to a frequency multiplexer which permits the bidirectional conversion of at least two intermediate angularly distinct planar wavefronts into a single directional wavefront by the use of a blazed diffraction grating mounted at the aperture of an antenna, where each distinct planar wavefront can correspond, for example, to the wavelength of a separate radio channel.

2. Description of the Prior Art

Various arrangements are known using stripline or waveguide elements such as, for example, branching filters for separating or multiplexing a plurality of radio channels comprising separate frequency bands. In this regard, see for instance, U.S. Pat. Nos. 3,428,918 issued to G. L. Matthaei on Feb. 18, 1969, and 3,698,001 issued to M. Koyama et al on Oct. 10, 1972.

U.S. Pat. No. 2,702,859 issued to C. V. Robinson on Feb. 22, 1955 discloses a directional microwave reflector type antenna comprising a reflector having small plates or zones to produce a scanning radiation beam having a planar wavefront when illuminated by a line source reciprocating normal to itself across the aperture of the reflector.

U.S. Pat. No. 3,108,279 issued to R. A. Eisentraut on Oct. 22, 1963, relates to a antenna reflector having different reflecting properties for incident electromagnetic radiation of different wavelengths. More particularly, the surface of the reflector is provided with small steps or grooves across the width thereof which focus incident waves within a desired wavelength range at the focal area of the reflector while reflecting incident waves of much shorter wavelength in a direction to avoid the focal area.

An article by K. B. Mallory et al entitled "A Simple Grating System for Millimeter and Submillimeter Wavelength Separation", *IEEE Transactions on Microwave Theory and Techniques,* Vol, 11, No. 5, September 1963, pages 433–434, describes an echelette grating spectrometer having rectangular facets set at a constant angle to the surface of the grating. There, two horn-fed parabolic reflectors are mounted with their axes intersecting at a predetermined angle. The axis of rotation of the grating is parallel to the long edges of the rectangular facets of the grating and by tilting the grating it is possible to reflect the desired wavelength to the receiving feedhorn while diverting the unwanted wavelengths out of the principal plane of the spectrometer.

An article entitled "A Grating Spectrometer for Millimeter Waves" by R. J. Coates in *Review of Scientific Instruments,* Vol. 19, No. 9, September 1948, pages 586–590, discloses an echelette grating spectrometer wherein the grating is formed to rotate about its axis in a manner whereby the normal distance between adjacent parallel flat reflectors changes as a result of this rotation. With this grating arrangement, energy, having a plane phase front, incident upon the grating is reflected back to the same position regardless of the grating angle. The signals associated with a sending and a receiving feedhorn are directed by a single curved reflector at the grating, and the angle corresponding to a peak received signal is read from the records and the wavelength calculated using a particular formula.

BRIEF SUMMARY OF THE INVENTION

The present invention relates to a frequency multiplexer employing a blazed diffraction grating and, more particularly, to a frequency multiplexer which permits the bidirectional conversion of at least two intermediate angularly-distinct planar wavefronts into a single directional wavefront by the use of a blazed diffraction grating mounted at the aperture of an antenna, where each distinct planar wavefront can correspond, for example, to the wavelength of a separate radio channel.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
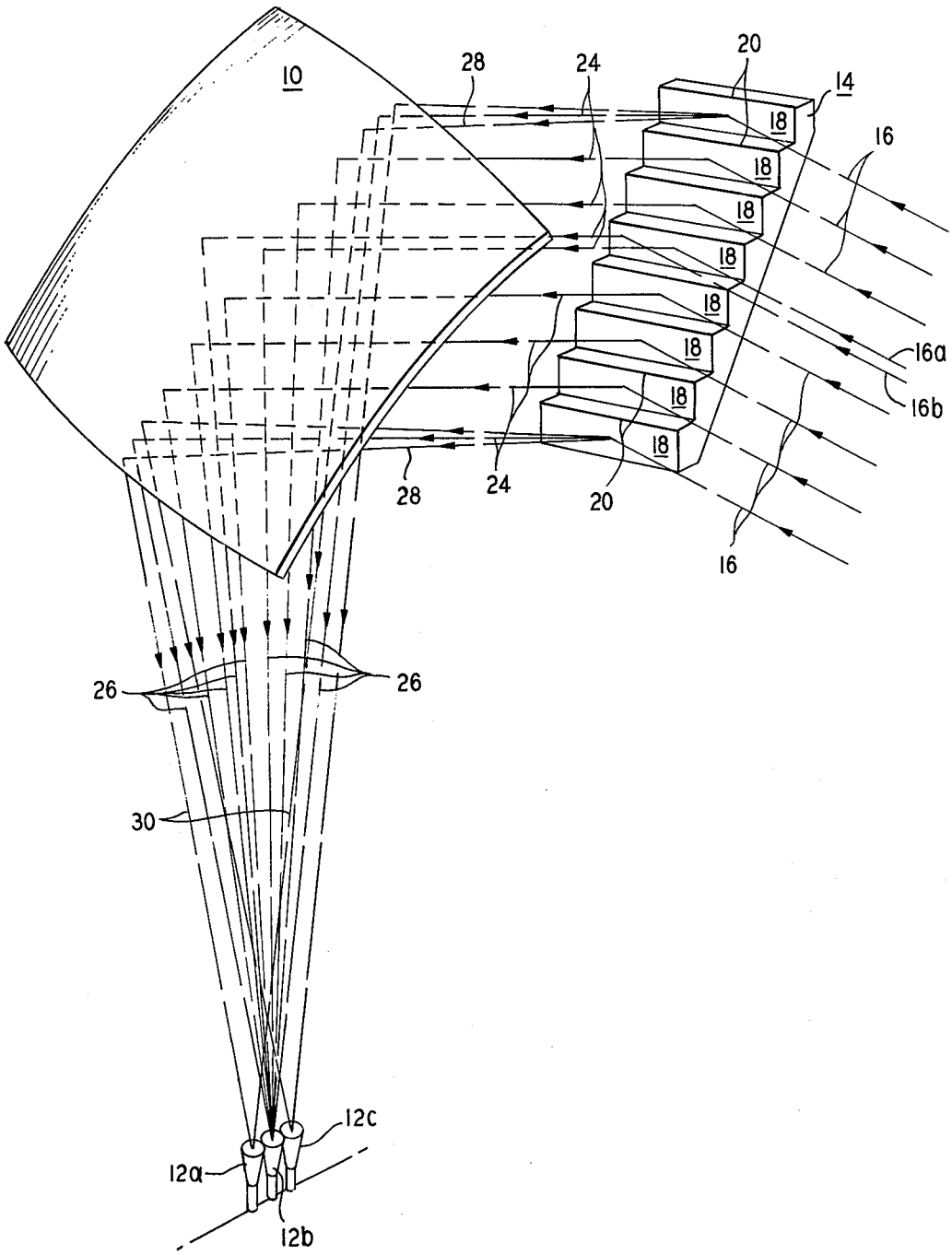
FIG. 1 is a perspective view of a frequency multiplexer in accordance with the present invention.
Figure 3:
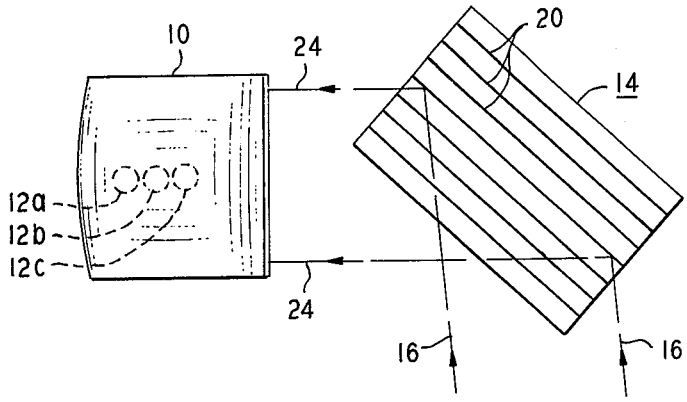
FIG. 3 illustrates a top view of the arrangement of FIG. 1.
Figure 4:
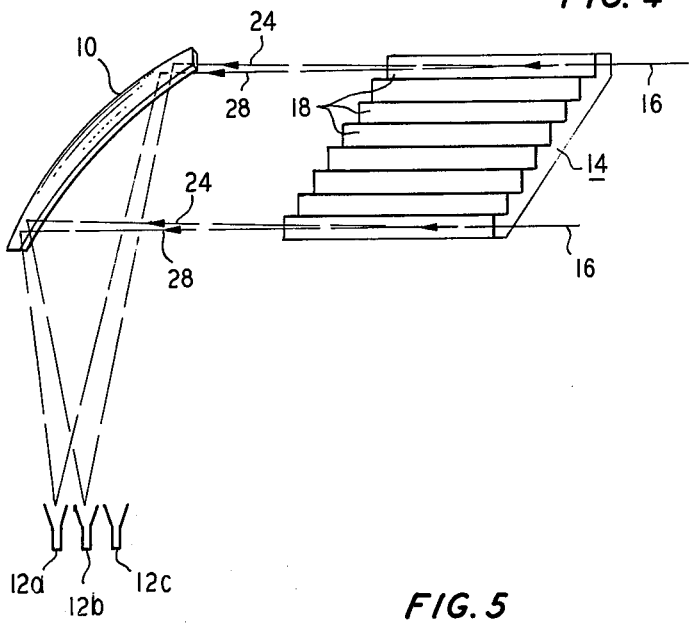
FIG. 4 illustrates a side view of the arrangement of FIG. 1.

Referring now to the drawings, FIG. 1 shows the basic configuration of a frequency multiplexer in accordance with the present invention. There, the present frequency multiplexer is shown as comprising (a) an offset parabolic antenna comprising a parabolic reflector 10 and a plurality of offset feedhorns, of which three feedhorns 12*a*, 12*b* and 12*c* are shown, mounted along the feed axis of reflector 10 and at the focal point of associated beams being reflected by reflector 10, and (b) a blazed diffraction grating 14 mounted in the aperture of the antenna. The spatial relationships between the above-mentioned elements are shown in FIGS. 3 and 4 which illustrate a top and a side view of the arrangement of FIG. 1, respectively. Parabolic reflector 10 and the associated feedhorns 12 can, for example, take the form of the well-known horn reflector which is slightly modified to accommodate the desired plurality of feedhorns 12 at the narrow end thereof.

The present frequency multiplexer depends on the diffraction properties of a metallic blazed diffraction grating 14, resembling, for example, a staircase but could also include other blazing profiles such as, for example, the profile disclosed in the article "On the Efficiencies of Rectangular-Groove Gratings" by J. L. Roumiguieres et al in *Journal of the Optical Society of America,* Vol. 66, No. 8, August 1976 at pp. 772–775, to provide the necessary frequency discrimination. Since grating 14 has no resonant elements, it is relatively lossless when compared with prior art waveguide filters. The operation of the blazed diffraction grating 14 is clearly shown in FIG. 2.

Figure 2:
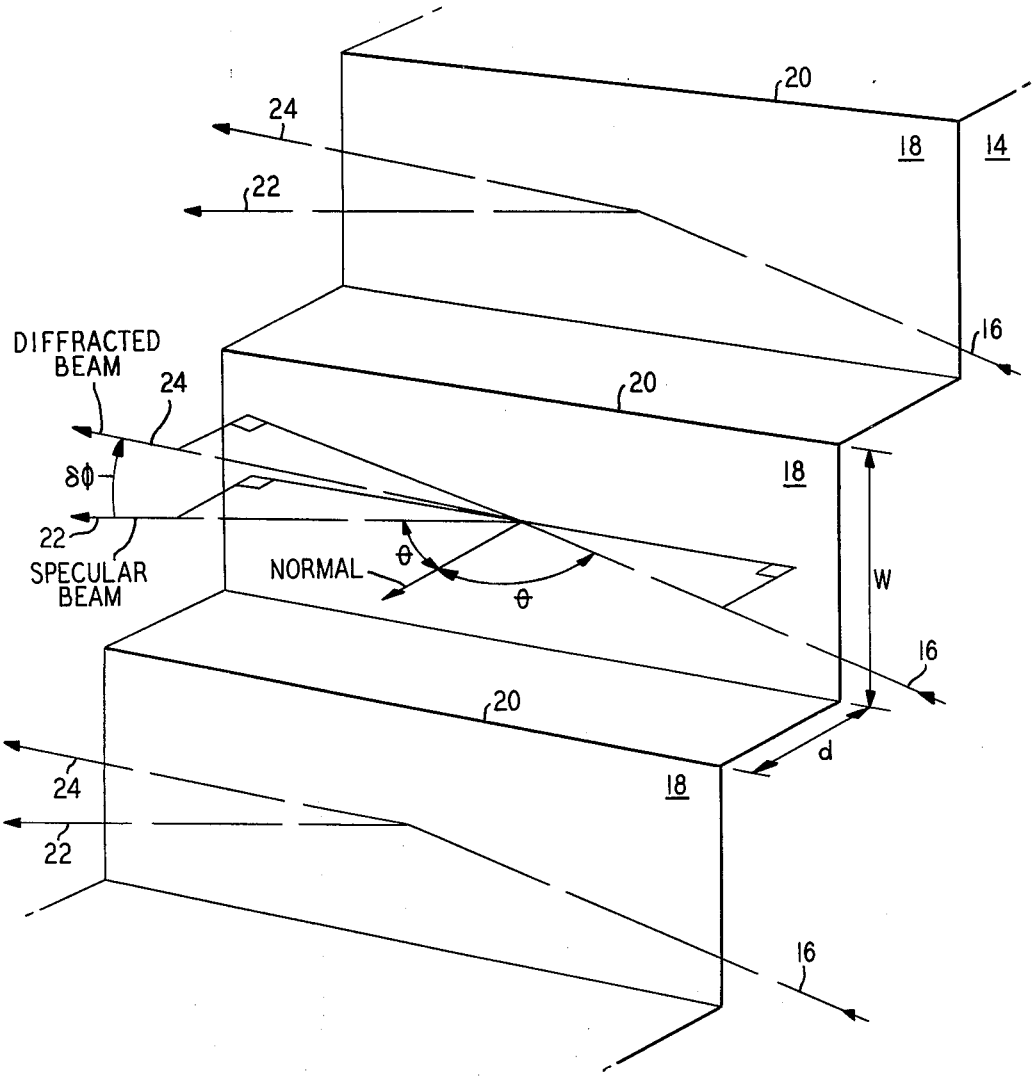
FIG. 2 is a perspective view of a portion of the blazed diffraction grating used with the frequency multiplexer of FIG. 1, the size of the grating steps being exaggerated for clarity.

In FIG. 2 a plane wave 16 is shown directed at the steps or reflecting planes 18 of blazed diffraction grating 14 with the plane of incidence parallel to the long edges 20 of the reflecting planes 18, and with the electric field normal to the plane of incidence. Specular reflection, shown by vector 22, occurs when $$m\lambda = 2d \cos \theta, \tag{1}$$

where $m$ is the spectral order and is an integer, $\lambda$ is the wavelength of the incident radiation, $d$ is the perpendicular distance between the reflecting planes 18 and $\theta$ is the angle of incidence. That is, for a wavelength $\lambda'$ satisfying Equation (1), the rays reflected from the separate reflecting planes 18 all add in phase in the direction given by the geometrical laws of reflection. For a first wavelength $\lambda_0$ not satisfying Equation (1), the beam emerging from grating 14 is diffracted out of the plane of incidence, as shown by vector 24, by an angle, $\delta\phi$, such that $$\delta\phi \cong \frac{m\delta\lambda}{w}, \tag{2}$$

where $\delta\lambda = \lambda - \lambda_0$ and $w$ is the width of each reflecting planes 18. Thus, as shown in FIG. 1, a feedhorn, e.g., feedhorn 12*b*, placed in the focal plane of a collecting means, such as parabolic reflector 10, can be coupled to a specifc band of frequencies in the incident beam 16.

The minimum frequency difference that can be resolved by the grating 14 depends on the angular spread, $\delta\phi'$ of a diffracted monochromatic beam:

$$\delta\phi' \cong \frac{\lambda}{W} = \frac{\lambda}{Nw} \tag{3}$$

where W is the total width of the grating 14 perpendicular to the plane of incidence, and N is the number of reflecting planes 18 in grating 14. To resolve two frequencies separated by $\delta f$, it is required that $\delta\phi \geq \delta\phi'$, or $$\frac{\delta f}{f} \geq \frac{w}{Wm} = \frac{1}{Nm} \tag{4}$$

The main source of inefficiency or loss of signal power with ordinary reflection gratings is diffraction into unwanted orders. With the blazed grating, however, virtually all of the incident power goes into a single spectral order.

As shown in FIG. 1, the blazed grating 14 can be mounted at the aperture of, for example, a horn antenna to form a frequency multiplexer. In order to avoid awkward grating geometry, it is convenient to let $d = w$. For this case it is determined from Equations (1) and (4) that $$\delta f \geq \frac{fw}{\mathrm{mW}} = \frac{c}{2W \cos \theta}, \tag{5}$$

where $c$ is the velocity of light. Note that the frequency resolution depends only on the available aperture W, and not on the carrier frequency. For a 1 meter antenna with $\theta = 45°$, $\delta f \geq 212$ MHz.

If the feedhorn radiation pattern is circular, the geometry of the multiplexer causes the final antenna beam to be elliptical. This distortion can be reduced by reducing $\theta$, the angle of incidence.

As shown in FIG. 1, individual rays 16 forming the received directional planar wavefront, which comprises one or more radio channels, arrive at blazed diffraction grating 14 preferably with the plane of incidence parallel to the long edges 20 of reflecting planes 18 and with the electric field normal to the plane of incidence. The directional planar wavefront impinges on a major surface area of grating 14, as shown, for example, by rays 16*a* and 16*b* which are shown incident on different areas of the same reflecting plane 18. As explained hereinbefore, all components of rays 16 having a first wavelength $\lambda_0$, which can correspond, for example, to a first radio channel, are diffracted out of the plane of incidence by an angle $\delta\phi$ to form a first intermediate angularly distinct planar wavefront as indicated by the parallel rays 24. The parallel rays 24 are reflected by parabolic reflector 10, as shown by rays 26 towards a first focal point thereof where, in turn, feedhorn 12*b* is positioned to capture these rays.

In a like manner, components of rays 16 having a second wavelength $\lambda_1$, which can correspond, for example, to a second radio channel, are diffracted out of the plane of incidence by an angle $\delta\phi_1$ to form a second intermediate angularly distinct planar wavefront as indicated by parallel rays 28 in FIG. 1. The parallel rays 28 are reflected by parabolic reflector 10, as shown by rays 30, towards a second focal point thereof where, in turn, feedhorn 12*a* is positioned to capture these rays. Similarly, components of rays 16 having a third wavelength $\lambda_2$ corresponding to, for example, a third radio channel will be diffracted out of the plane of incidence by an angle $\delta\phi_2$ to be ultimately captured, for example, by feedhorn 12*c* which is aligned with feedhorns 12*a* and 12*b*.

Although it is preferable the blazed diffracton grating 14 be oriented with respect to the received directional planar wavefront represented by rays 16 such that the plane of incidence is parallel to the long edges 20 of reflecting planes 18 and with the electric field normal to the plane of incidence, frequency discrimination is still achievable when the plane of incidence is not parallel to the long edges 20 and the electric field is not normal to the plane of incidence. However, it has been found that the efficiency of the present frequency multiplexer decreases as the plane of incidence moves away from parallelism with long edges 20 of reflecting planes 18 and the electric field moves away from normal with the plane of incidence.

The present frequency multiplexer has been described primarily in the resolving of a directional planar wavefront into separate radio channels by the use of a blazed diffraction grating 14 mounted in the aperture of an antenna. It is to be understood that a plurality of radio channels, where each radio channel is launched by a separate feedhorn of an antenna system, and in turn, is represented by separate intermediate angularly distinct planar wavefronts, can also be combined into a single directional planar wavefront by a blazed diffraction grating 14 mounted in the aperture of the antenna system in a reverse manner to that hereinbefore described for resolving radio channels.

Figure 5:
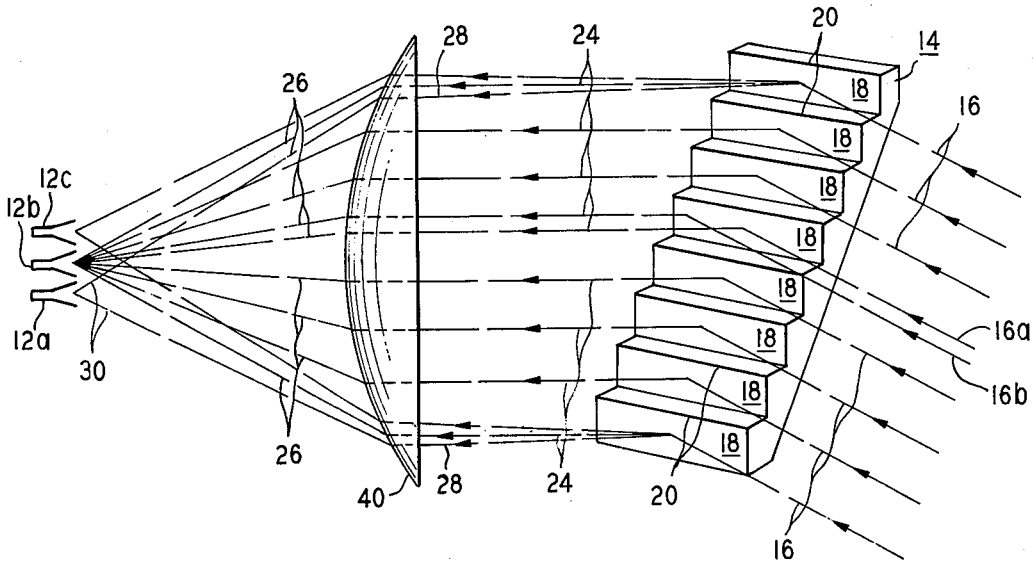
FIG. 5 illustrates an alternative arrangement to FIG. 1 in accordance with the present invention where a dielectric lens is substituted for the reflector of FIG. 1.

It is to be understood that the above-described embodiments are simply illustrative of the principles of the invention. Various other modifications and changes may be made by those skilled in the art which will embody the principles of the invention and fall within the spirit and scope thereof. For example, the antenna system comprising reflector 10 and feedhorns 12 can comprise any antenna system other than a horn reflector which transforms waves radiated from a feedhorn at a focal point of a reflector into a planar wavefront. The antenna system can also comprise a collecting lens 40 as shown typically in FIG. 5 with associated feedhorns, the arrangement being comparable in operation to that described for FIGS. 1 and 2. The present invention advantageously has low loss, combines or resolves a plurality of channels simultaneously, and is capable of handling high power levels.

What is claimed is:

1. A frequency multiplexer comprising:

a focusing means having a given focal plane and an aperture, the focusing means being capable of focusing each of at least two intermediate angularly distinct planar wavefronts in the aperture thereof towards a separate location on said given focal plane and transforming electromagnetic waves radiating from at least two locations on said given focal plane into separate intermediate angularly distinct planar wavefronts in the aperture thereof;

a blazed diffraction grating, the grating being disposed in the aperture of the focusing means and in a manner to bidirectionally transform said at least two intermediate angularly distinct planar wavefronts into a single directional planar wavefront, each of said at least two intermediate angularly distinct wavefronts corresponding to signals of a separate wavelength; and at least two feedhorns, each feedhorn being associated with a separate one of said at least two intermediate angularly distinct planar wavefronts and disposed on said given focal plane at the location where the associated intermediate angularly distinct planar wavefront is focused by said focusing means.

2. A frequency multiplexer according to claim 1 wherein the blazed diffraction grating is disposed to have the plane of incidence of the single directional planar wavefront substantially parallel to the long edges of the plurality of stepped reflecting planes.

3. A frequency multiplexer according to claim 1 wherein the focusing means is curved reflector.

4. A frequency multiplexer according to claim 1 wherein the focusing means is a collecting lens.

* * * * *